US006033191A

United States Patent [19]

Kamper et al.

[11] Patent Number: 6,033,191

[45] Date of Patent: Mar. 7, 2000

[54] MICROMEMBRANE PUMP

[75] Inventors: Klaus-Peter Kamper, Roetgen; Joachim Dopper, Gross-Gerau, both of Germany

[73] Assignee: Institut Fur Mikrotechnik Mainz GmbH, Germany

[21] Appl. No.: 08/974,717

[22] Filed: Nov. 19, 1997

[30] Foreign Application Priority Data

May 16, 1997 [DE] Germany ..... 197 20 482

[51] Int. Cl.[7] ..... F04B 17/00

[52] U.S. Cl. ..... 417/322; 417/413.2

[58] Field of Search ..... 417/413.2, 413.1, 417/322

[56] References Cited

U.S. PATENT DOCUMENTS 5,271,724 12/1993 Van Lintel ..... 417/413 A
5,542,821 8/1996 Dungan ..... 417/53
5,836,750 11/1998 Cabuz ..... 417/322

*Primary Examiner*—Timothy S. Thorpe
*Assistant Examiner*—Ehud Gartenberg
*Attorney, Agent, or Firm*—Hudak & Shunk Co., L.P.A.; Daniel J. Hudak

[57] ABSTRACT

A micromembrane pump is described which is self-priming and self-filling. For this, the pump chamber (14) is so configured that in a drained condition of the pump chamber (14), the pump membrane (4) adjoins the pump chamber wall (22), which causes the volume of the pump chamber (14) to be minimized. For this, the pump chamber wall (22) can be flat, so that the pump membrane (4) adjoins the flat pump chamber wall (22) in its unshifted rest position. Preferably, the pump includes membrane valves which consist of a valve membrane (3) situated between two halves of the housing (1, 2), and valve seats (10, 16). It also includes a heteromorphic piezoactuator (5) attached to the pump membrane (4). The compact pump is suited to deliver gases and liquids, and can be manufactured in cost-effective fashion from only a few components.

14 Claims, 3 Drawing Sheets

MICROMEMBRANE PUMP

Figure 1:
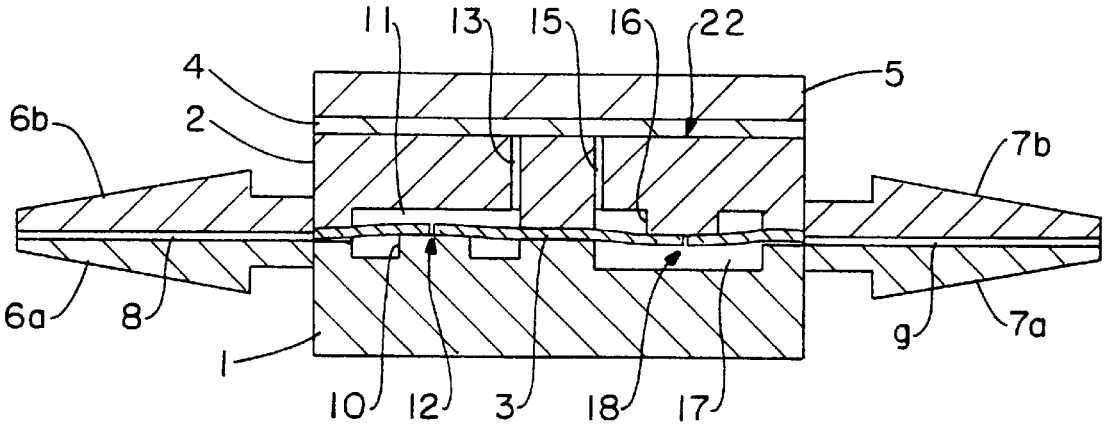

The invention has to do with a micromembrane pump for delivering gases and liquids.

Micromembrane pumps are increasingly used in areas such as chemical analysis, microreaction technology, biochemistry, microbiology, and medicine.

Many of these applications require that micromembrane pumps be able to deliver liquids in a problem-free manner. For this, it is very advantageous that the pumps be self-priming. To be able to draw in liquids in a pump initially filled only with air, a sufficiently high negative pressure must be generated when operating with air. Additionally, it is required that the pumps also be self-filling, i. e. that no gas bubbles remain in the pump which would impair pump performance. In addition to that, as a rule it is required that flow rates for liquids be in the range of 1 microliter/min to 1 ml/min. For this, often a delivery pressure of at least 500 hecto Pascale is demanded. The materials that come into contact with the material to be delivered should be sufficiently chemically inert or biocompatible. To facilitate economical use, micromembrane pumps should be manufactured in a cost-effective manner.

The micropump proposed by H. T. G. van Lintel et al. in "A piezoelectric micropump based on micromachining of silicon" (Sensors and Actuators, 15, 1988, pp. 153–157) consists of silicon with a pump membrane made of glass which is shifted by a piezoceramic. One disadvantage is that the glass membrane's warping is slight in comparison with the size of the pump chamber, thus making gas delivering impossible. Silicon as a material is not suited for many applications such as in medicine. Additionally, manufacturing using a microtechnological processing procedure for silicon is expensive, and very costly owing to the relative large space required.

DE-A1-4402119 describes a micromembrane pump which consists of a lower housing, an upper housing and a pump membrane situated between them, with the membrane taking on a valve function as well, operating together with the valve seat designed into the housing. The membrane blocks off both the pump chamber situated in the lower housing and the actuator chamber found in the upper housing. A heating element linked with the pump membrane is suggested as a driving apparatus. The pump membrane is shifted by thermal expansion of a gaseous medium or by phase transition of a liquid medium to its gaseous state in the actuator chamber. Owing to thin-layer-technology manufacturing of the heating spiral, manufacture is expensive, and therefor cost-intensive. When fluids are delivered, greater heating capacity is required because of the markedly greater heat removal via the liquid. This leads to a heating of the liquid which is particularly undesirable in biochemistry applications. If the liquid flow is interrupted by such phenomena as gas bubbles, this can lead to overheating of the heating spiral. Lastly, continuous operation of the pump is not easy to achieve because of meager heat transmission by the plastic housing.

A micromembrane pump made of two housing components that are separated by a membrane serving both as a pump and valve membrane was suggested by J. Dopper et al ("Development of lowcost injection molded micropumps," Proceedings of ACTUATOR 96, Bremen, Jun. 26–28, 1996). A pump chamber which is closed off by the membrane is designed into the lower housing. The pump chamber is connected via microchannels with the two membrane valves. A heteromorphic piezoactuator serves as the driving mechanism. The housing components as well as the membranes are joined to each other by laser welding. One significant disadvantage of this, as well as the pumps previously described, is that they are not self-priming and self-filling. Costly manual filling makes it impossible to achieve broad application of these pumps for the above-named applications.

The object of the invention is to make available a micromembrane pump that meets the above-named requirement, particularly of being self-priming and self-filling.

This object is attained by the features of patent claim 1. The subordinate claims describe advantageous embodiments of the invention-specific micromembrane pump.

In the pump chamber's drained condition, the pump membrane is situated at the pump chamber wall. Because of this, the pump chamber is only formed when the pump membrane is shifted away from this position. By this means, the interior residual volume of the pump relative to the pump chamber volume is minimized. By interior residual volume we here mean the volume between the intake and outlet valve, which embraces both of the areas of the valve chambers that face the pump chamber, the pump chamber in its drained state, and both of the channels connecting the pump chamber with the valve chambers. With simultaneous minimization of the volume of the areas between the valves and the pump chamber, the smallest possible interior pump residual volume can be attained, as compared with the maximum volume of the pump chamber. By this means, high working pressures for gases can be attained despite their compressibility. The advantage of this is that the pumps can also build up the negative pressure required to draw in liquids automatically. When the pump chamber is drained, the pump membrane is largely to totally adjacent to the pump chamber wall, i. e., the volume of the pump chamber in this pump membrane position is negligibly small. Therefore, no so-called dead volume exists in the pump chamber in which gas bubbles delivered with the liquid medium could collect, thus impairing the pump's function. Thus, the pump is self-filling. Additionally, a negligibly small dead volume is a prerequisite for a low level of mixing of the medium to be delivered. This permits use of the pump in such areas as chemical analysis, where media with concentration gradients are to be delivered.

In accordance with a preferred embodiment, the pump membrane in its non-shifted rest position lies flat at the pump chamber wall which is also essentially flat. Another embodiment has the pump chamber wall arched in concave fashion, its shape being, for example, hemispherical. The pump membrane adjoins the pump chamber wall only in a shifted position.

Also preferred is an embodiment in which the interior residual volume, which is predominantly determined by the areas between the two valves and the pump chamber, is minimized, so that the ratio of this volume to the maximum attainable pump chamber volume is approximately 1:1. One particularly advantageous embodiment exhibits a ratio of 1:10. An interior residual volume that is that small in comparison to the maximum pump chamber volume allows high working pressures to be achieved for gases. Liquids can also be drawn away over great heights in a pump filled with air.

Furthermore it is preferred that the intake and outlet valves are formed from membrane valves. Preferably a membrane valve consists of a valve seat, which consists of a raised microstructure in the valve chamber and a membrane which is placed opposite the valve seat and has at least one hole. The height of the valve seat can be designed so that the membrane does not touch it, or lies right on the valve seat, or is stretched over it, depending on the pressure difference at which the valve should open or close. However, use of such components as microsphere valves or dynamic valve types such as nozzles or diffuser structures, or tesla diodes, is also possible.

If the pump membrane serves simultaneously as a valve membrane, then for this the valves are situated at the side of the pump chamber connected via microchannels with the valves.

However, along with the pump membrane, preferably the micromembrane pump has a valve membrane as an additional membrane. For this it is advantageous to have the housing consist of two halves, an upper housing and a lower housing. On its upper side, the upper housing, together with a pump membrane attached to this side, forms the pump chamber. By means of microchannels, the pump chamber is connected with valve chambers designed into the underside of the upper housing. A valve chamber has a valve seat to form the outlet valve. The lower housing likewise contains recesses for guiding the medium flowing through as well as the valve seat for the intake valve. Between the two halves of the housing, there is preferably one valve membrane in which, in the area of the valve seats, at least one hole is designed in. In this embodiment with one pump membrane and one valve membrane, it is particularly advantageous to have the valves situated facing the pump chamber, so that, in contrast to a lateral layout of valves, the pump can be configured to be very compact.

It is more advantageous to have the pump housing exterior so configured that intakes and outlets for the medium to be extracted can easily be connected with the pump. Examples of this are conical structures, equipped with undercuts, that are provided for attachment to hoses.

Additionally, it is advantageous to have one half of the housing provided with structures such as pins or flanges that fit into complementary structures like holes or grooves in the other half of the housing. This makes possible simple relative adjustment of the two housing parts to each other during pump assembly. If a valve membrane is provided between the two halves of the housing, then it is advantageous that in the area of the adjustment pieces, it should have corresponding recesses such as holes or slots.

Preferably the housing components, pump membrane and/or the valve membrane will consist of plastics such as polycarbonate, PFA, or other chemically inert and/or biocompatible materials. Molding procedures such as microinjection molding are suited to be cost-effective manufacturing processes for the housing components.

Treatment of the surfaces that are in contact with the medium to be delivered by such agents as a plasma can be advantageous, owing to increased wettability, in order to facilitate bubble-free filling of the pumps with certain liquids.

Preferably the housing will consist of plastic components welded together. Laser welding will preferably be suited to join the components. For this, a laser beam is focussed on the boundary surfaces of two components to be welded, and run along the surfaces to be welded. It can also be advantageous if the welding surfaces adjoin each other so closely that essentially the entire boundary surface between the individual components is welded, except for the areas of the valve chambers and the pump chamber.

It is advantageous to have one of the components be transparent in the wavelength range of the laser beam employed, while the other component absorbs light in this wavelength. During the welding process, the laser beam passes through the transparent material and is focussed on the boundary surface of the nontransparent material. Absorption at the boundary surface results in local heating, and thus in a penetrating fusion of the materials. Along with secure joining of the components, this makes possible a sealing off of the individual regions of the micromembrane pump through which flows take place, both from each other and from the outside. By means of beam partition, preferably several locations, and also several micropumps, can be welded simultaneously. It is true that the components can be joined to each other by means of other processes such as adhesive bonding.

Piezoelectric, thermoelectric or thermal elements can be connected with the pump membrane as a device for shifting the pump membrane. It is also possible to provide hydraulic, pneumatic, electromagnetic or electrostatic drive mechanisms, or ones based on shape memory alloys. These can be integrated in the micropump housing or attached from outside.

Use of at least one heteromorphic piezoactuator as a device for shifting the pump membrane is preferred. The entire piezoactuator can be joined with the pump membrane by such processes as adhesive bonding. Warping of the piezoactuator is induced by an applied voltage. This results in shifting of the pump membrane and in a change of the pump chamber volume. By this means, a pressure differential is produced between the inlet channel and the pump chamber. If the pressure difference is great enough, the inlet valve opens so that the medium to be delivered flows into the pump chamber. As the membrane shift comes to an end, the pressure differential decreases, so that the inlet valve closes. With reversal of the applied voltage, the volume of the pump chamber decreases. When a pressure differential between the pump chamber and the outlet that depends on the size of the valve is reached, the outlet valve opens and the medium is compressed in the direction of the outlet channel. Periodic control actions by the piezoactuator permit a quasi-continuous delivering to be achieved.

The invention-specific micromembrane pumps can be manufactured cost-effectively in large quantities through a compact design made of few components, using simple manufacturing and fastening techniques.

In what follows, an embodiment example will be explained in greater detail with the aid of drawings.

Shown are:

FIG. 1: a micromembrane pump with a flat pump chamber wall in cross section from the side, depicted schematically.

Figure 2:
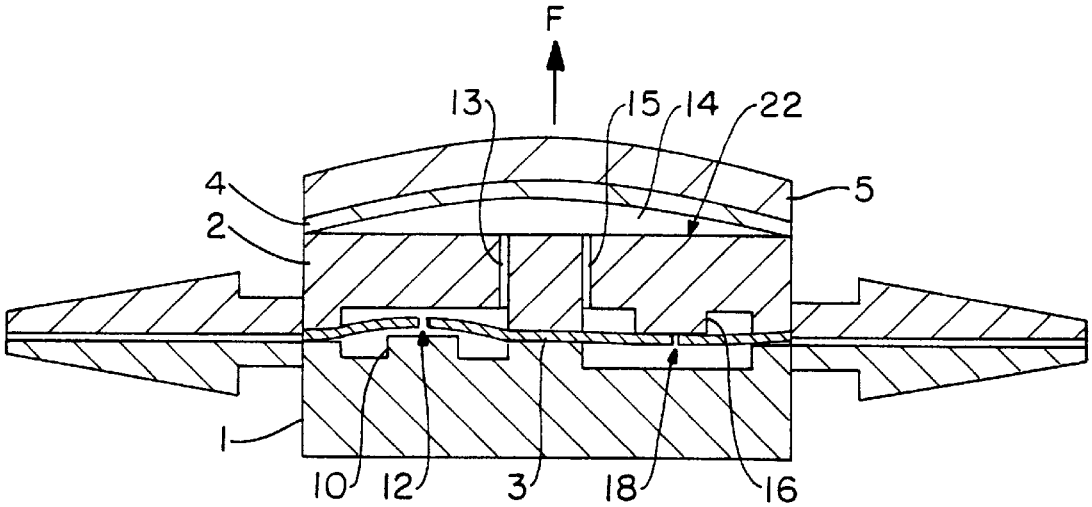

FIG. 2: the micromembrane pump as per FIG. 1, during ingestion.

Figure 3:
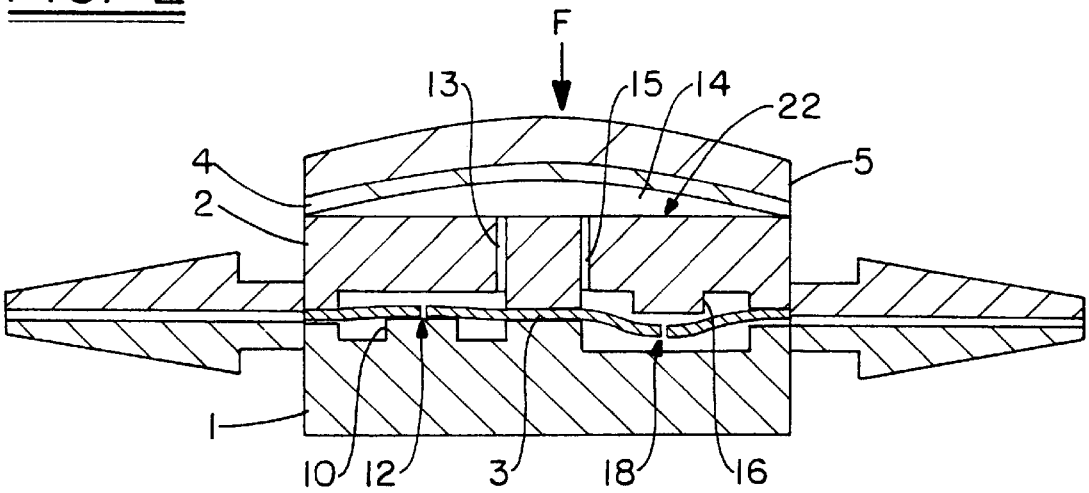

FIG. 3: the micromembrane pump as per FIG. 2 during draining.

Figure 4:
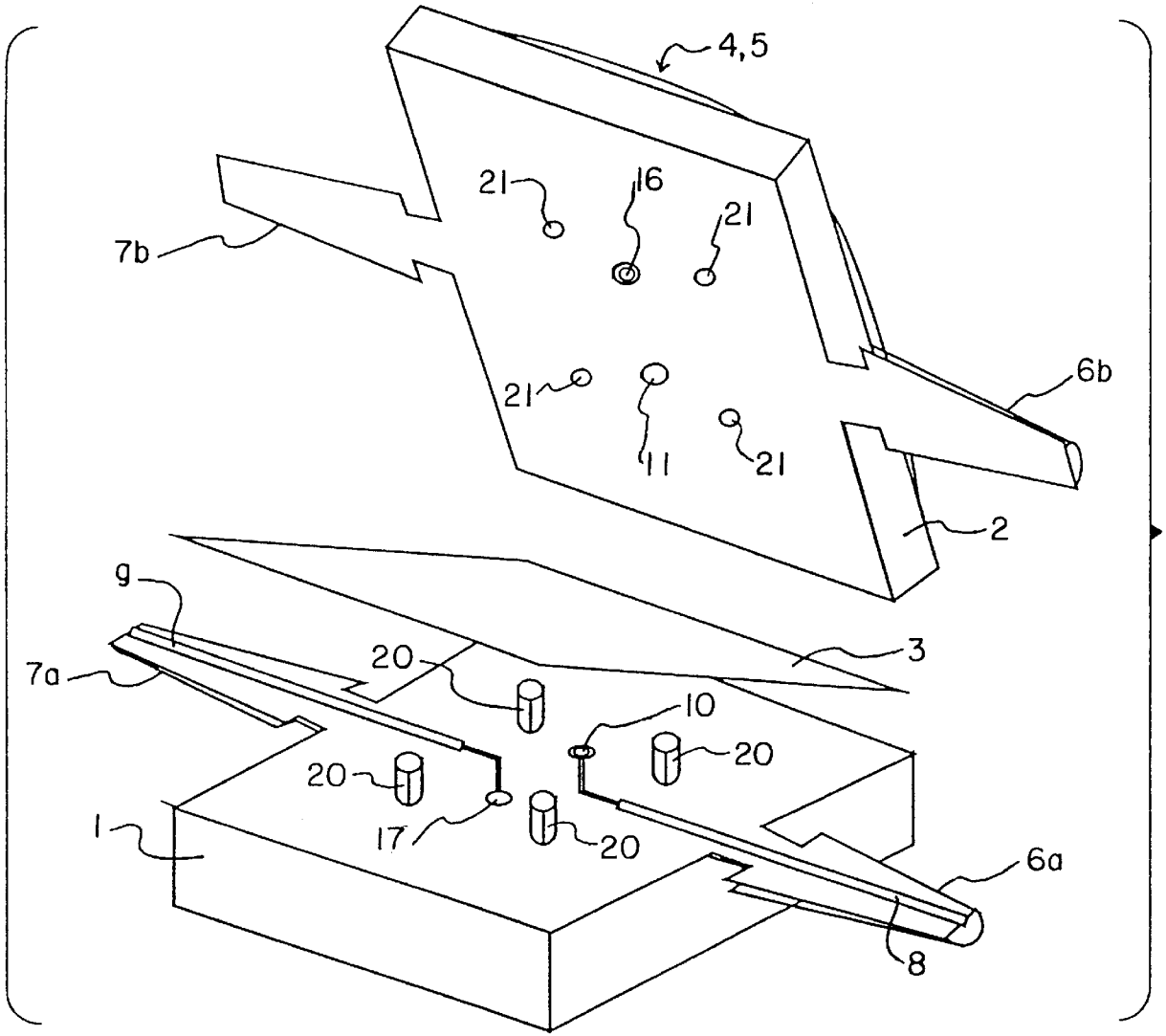

FIG. 4: The lower housing, the valve membrane and the upper housing of a micromembrane pump in a perspective view.

Figure 5:
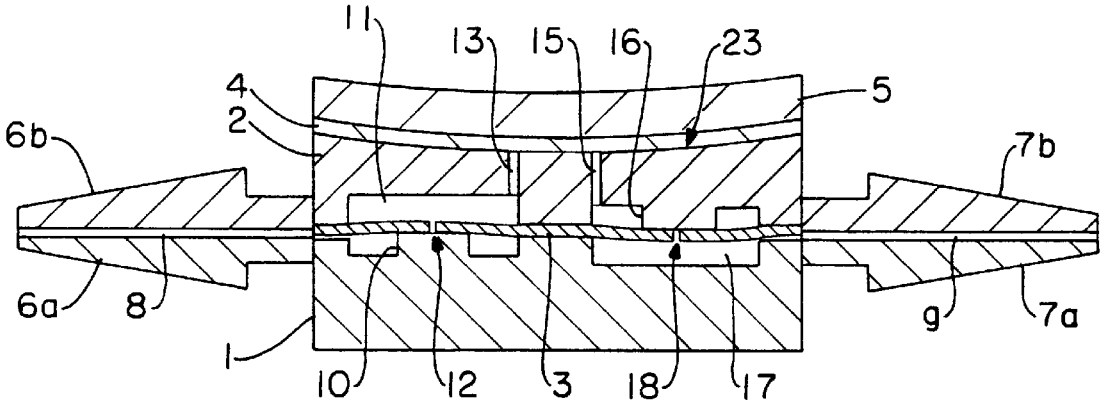

FIG. 5: a micromembrane pump with an arched pump chamber wall in cross section from the side, depicted schematically.

Figure 6:
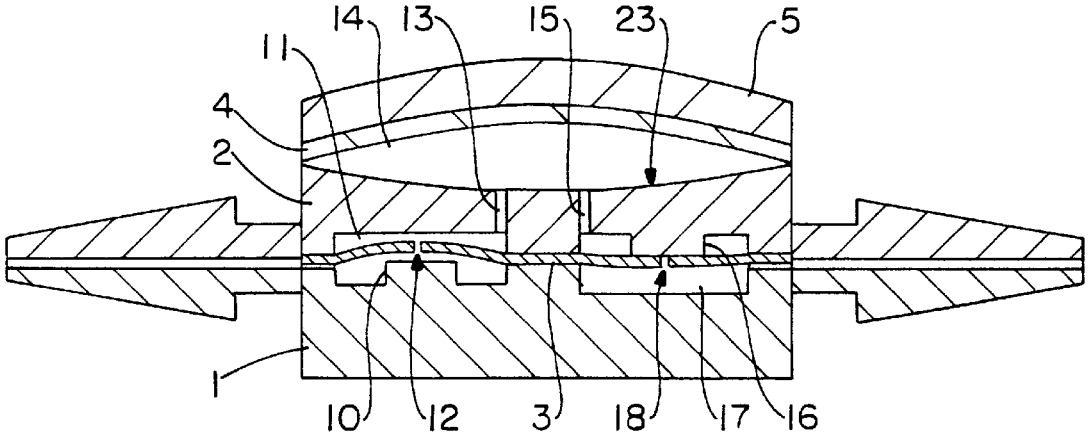

FIG. 6: the micromembrane pump as per FIG. 5 during ingestion.

None of the illustrations are drawn to scale.

The micromembrane pump depicted schematically in FIG. 1 consists of a lower housing 1, an upper housing 2, a valve membrane 3 situated between the two halves of the housing 1, 2, and a pump membrane 4, to which a piezoactuator 5 is attached.

On two opposite sides, the halves of the housing are configured so that together they form a hose attachment 6*a*, 6*b* laterally on the pump, for the inlet, and an attachment 7*a*, 7*b* for the outlet. In their interior, both attachment pieces have an inlet channel 8 and an outlet channel 9. In a recess of lower housing 1, a valve seat 10 is designed in; above it, there is a hole 12 in the valve membrane 3. Opposite it is a recess 11 in the underside of upper housing 2, which is connected via a microchannel 13 with pump chamber 14. Pump chamber 14 is bordered by pump membrane 4 and the flat upper housing wall that constitutes the pump chamber wall 22. Pump membrane 4 with adjoining piezoactuator 5 is attached to the edge area of the top side of upper housing 2, such that the cross section from above, of pump chamber 14 is round. In this figure, pump membrane 4 lies on the flat pump chamber wall 22, so that the volume of pump chamber 14 in this non-shifted neutral position of pump membrane is negligibly small. Another microchannel 15 connects pump chamber 14 with a recess in the underside of upper housing 2, in which valve seat 16 of the outlet valve is located. At the top of valve seat 16, valve membrane 3 has a hole 18. By way of a recess 17 in lower housing 1, the outlet valve is connected with outlet channel 9. Microchannels 13 and 15 empty out into a middle area of pump chamber wall 22. This prevents intake or outflow of the medium to be delivered from being interrupted by covering the openings of microchannels 13, 15 with a pump membrane 4 that already adjoins pump chamber wall 22 on the edge side. For the sake of clarity, the dimensions, particularly of the valves and membranes, are depicted to be greatly enlarged in comparison with the overall dimensions of the pumps.

FIG. 2 depicts the micromembrane pump during the ingestion process. By warping of piezoactuator 5, pump membrane 4 is shifted with a force F, causing pump chamber 14 to be formed. The opened inlet valve with valve membrane 3 with a hole 12, lifted from valve seat 10, is likewise depicted schematically.

FIG. 3 depicts the draining process of the pump schematically. By means of piezoactuator 5, a force F acts on pump membrane 4, thus causing pump chamber 14 to be reduced in size. When a critical pressure is reached, the outlet valve opens. Valve membrane 3 with a hole is depicted as being raised from valve seat 16.

FIG. 4 shows a perspective view of lower housing 1, valve membrane 3 and upper housing 2 of an invention-specific micromembrane pump. In contrast to FIGS. 1 to 3, another relative scale has been selected. An inlet channel 8 and an outlet channel 9 have been designed into lower housing 1. The inlet valve is formed from valve seat 10, valve membrane 3 and recess 11. The outlet valve consists of valve seat 16, the valve membrane 3 and recess 17. The recesses in membrane 3 required for valve function are not depicted. Also not shown are the microchannels 13, 15, which lead from the two recesses for the valves in the depicted underside of upper housing 2 to the pump chamber 14 that lies on the top side of upper housing 2. Both housing components 1, 2 have structures 6*a*, 6*b*, 7*a*, 7*b*, which form attachments for hoses when assembled together. Lower housing 1 has four pins 20 which fit into matching holes 21 of upper housing 2, thus making possible simple relative adjustment. Piezoactuator 5 and pump membrane 4 on the top side of upper housing 2 are barely visible.

FIG. 5 is a schematic depiction of another inventionspecific micromembrane pump. The same reference symbols have been used as in the previous figures. In contrast to a flat pump chamber wall 22 shown in FIGS. 1 to 4, here pump chamber wall 23 has a concave arch shape. Pump membrane 4 with attached piezoactuator 5 is connected with the edge area of the top side of upper housing 2. Pump chamber 14, whose cross section from above is round, is connected via microchannels 13 and 15 with the inlet and outlet valve. FIG. 5 shows pump membrane 5 shifted in such a way that it closely adjoins arched pump chamber wall 23. By this means, the volume of pump chamber 14 in this shifted position is negligibly small. FIG. 6 shows the same micromembrane pump with pump membrane 4 shifted in the opposite direction from the one in FIG. 5, during ingestion. Essentially it is only by this shifting of pump membrane 4 that pump chamber 14 is formed.

One invention-specific micromembrane pump was manufactured with exterior dimensions of 10 mm.×10 mm.×3 mm. The pump membrane had a thickness of 50 micrometers., and the valve membrane a thickness of 2 um. A heteromorphic piezoactuator with a diameter of 10 mm. served as the drive mechanism. This actuator consisted of a piezoceramic fastened to a brass plate by an electrically conducting bonding agent. The brass plate served as an electrode; a second electrode was attached to the other side of the disc-shaped piezoceramic. The entire piezoactuator was glued to the pump membrane.

The maximum volume of pump chamber 14 was about 600 nl, with a pump interior residual volume of only 60 nl. Essentially, the interior residual volume was determined by the two microchannels 13, 15, the recess 11 of the inlet valve, and the recess with the valve seat 16 of the outlet valve. Based on this favorable volume relation, a gas working pressure with air of about 500 hecto Pascale and a negative pressure of about 350 hPa was achieved, with the pump being self-priming. Using water, a working pressure up to 1600 hPa and a flow rate up to 250 microliter/min was achieved. The piezoactuator was run at a frequency of several tens of Hz.

The components of the micromembrane pump consisted of polycarbonate. The two parts of the housing 1, 2 were manufactured by a micro-injection molding process. The mould inserts needed for this were manufactured by a combination of precision engineering procedures: the LIGA process and electrical discharge machining. The holes 12, 18 in the valve membrane 3 as well as the microchannels 13, 15 through the upper housing 2 were made using laser ablation. The pump was fitted together in two steps. First, the two housing components 1, 2 were joined with the intermediately placed valve membrane 3 by laser welding. For this, a laser beam was focussed through the transparent lower housing 1 onto the 2 um-thick valve membrane 3, which lay on the dyed non-transparent upper housing 2. By this means, the three previously clamped-together components 1, 3, 2 were welded together. In a second step, the transparent pump membrane 4 was joined on its edge with the top side of the non-transparent upper housing 2, using laser welding. Thus, micromembrane pumps can be fit together in a few seconds for each joining operation.

List of Reference Numbers

1. Lower housing
2. Upper housing
3. Valve membrane
4. Pump membrane
5. Piezoactuator
6*a*. Connector for inlet
6*b*. Connector for inlet
7*a*. Connector for outlet
7*b*. Connector for outlet
8. Inlet channel
9. Outlet channel
10. Valve seat of inlet valve

11. Recess
12. Hole in valve membrane
13. Microchannel
14. Pump chamber
15. Microchannel
16. Valve seat of outlet valve
17. Recess
18. Hole in valve membrane
20. Positioning pin
21. Hole
22. Flat pump chamber wall
23. Arched pump chamber wall

What is claimed is:

1. A self-filing and self-priming micromembrane pump comprising:

a housing, said housing having a wall which serves as a pump chamber wall;

a pump membrane;

at least one device for shifting said pump membrane between a drained condition and a maximum volume condition;

at least one inlet valve and at least one outlet valve; and one pump chamber located between said pump chamber wall and said pump membrane, wherein said pump membrane adjoins said pump chamber wall substantially along its length when said pump membrane is in said drained condition, wherein said at least one inlet valve and said at least one outlet valve comprise: a single piece valve membrane, said valve membrane being separate from and substantially parallel with the pump membrane when in said drained condition, said single piece valve membrane controlling the flow through said at least one inlet valve and said at least one outlet valve; membrane valve seats formed from the structure of the pump housing, and wherein said valve membrane has at least one hole in an area adjacent to each of one said valve seats.

2. A micromembrane pump according to claim 1, wherein said pump chamber wall is arched in concave shape, and wherein said pump membrane adjoins said pump chamber wall substantially along its length when pump membrane is in said drained condition.

3. A micromembrane pump according to claim 1, wherein said pump chamber wall is flat, and wherein said pump membrane adjoins said pump chamber wall substantially along its length in said drained condition.

4. A micromembrane pump according to claim 3, wherein the ratio of the volume between said at least one inlet and said at least one outlet valves and said pump chamber in said drained condition to the maximum volume of said pump chamber is less than or equal to 1:10.

5. A micromembrane pump according to claim 1, wherein the ratio of the volume between said at least one inlet and said at least one outlet valves said pump chamber in said drained condition to the maximum volume of said pump chamber is less than or equal to 1:10.

6. A micromembrane pump according to claim 1, wherein said pump membrane and said valve membrane comprise the same material.

7. A micromembrane pump according to claim 1, wherein said housing comprises an upper housing and a lower housing, and wherein said valve membrane lies between said lower housing and said upper housing, and wherein said pump membrane is operatively attached to said upper housing so that said pump membrane is capable of shifting away from said upper housing thus forming said pump chamber.

8. A micromembrane pump according to claim 1, wherein connectors for intake and outlet lines for the medium to be delivered are integrated into said housing.

9. A micromembrane pump according to claim 7, wherein said upper housing and said lower housing have complementary structures such as pins, flanges, holes, or grooves that allow said upper housing and said lower housing to fit together.

10. A micromembrane pump according to claim 7, wherein said upper housing and said lower housing are welded together.

11. A micromembrane pump according to claim 10, wherein said welding comprises laser welding and wherein one housing component in the wavelength range used in laser welding is transparent, while the other housing component is not transparent.

12. A micromembrane pump according to claim 1, wherein said shifting device has at least one piezo-electric or thermoelectric element.

13. A micromembrane pump according to claim 12, wherein said shifting device has at least one heteromorphic piezoactuator.

14. A micromembrane pump according to claim 1, wherein said shifting device has at least one hydraulic, pneumatic, thermal, electromagnetic, or electrostatic drive mechanism, or one that has a shape memory alloy.

* * * * *